US005671195A

United States Patent [19]

Lee

[11] Patent Number: 5,671,195

[45] Date of Patent: Sep. 23, 1997

[54] AUDIO SYSTEM PROGRAMMABLE FOR RECORDING PRESELECTED AUDIO BROADCASTS

[75] Inventor: Howard Hong-Dough Lee, Bloomfield, Mich.

[73] Assignee: Intellectual Science and Technology Inc., Bloomfield, Mich.

[21] Appl. No.: 658,948

[22] Filed: May 31, 1996

[51] Int. Cl.[6] ..... H04H 9/00

[52] U.S. Cl. ..... 369/7; 360/7; 455/345

[58] Field of Search ..... 369/7, 6, 21, 84, 369/8, 9, 10, 12; 360/7, 5; 455/344, 345, 115, 127, 296, 297; 381/34, 35

[56] References Cited

U.S. PATENT DOCUMENTS

| | | | |
|---|---|---|---|
| 4,713,801 | 12/1987 | Hale | 369/7 |
| 4,766,580 | 8/1988 | Go et al. | 369/21 |
| 4,805,217 | 2/1989 | Morihiro et al. | 369/7 X |
| 5,126,982 | 6/1992 | Yifrach | 369/7 |
| 5,263,199 | 11/1993 | Barnes et al. | 369/7 X |
| 5,448,534 | 9/1995 | Okada | 369/7 |
| 5,463,599 | 10/1995 | Yifrach | 369/7 |
| 5,483,506 | 1/1996 | Yoshioka et al. | 369/7 |

FOREIGN PATENT DOCUMENTS

| | | |
|---|---|---|
| 59-94940 | 5/1984 | Japan . |
| 259639 | 10/1989 | Japan . |

*Primary Examiner*—Ali Neyzari

[57] ABSTRACT

An audio system comprising programmable means and power-distributing means is capable of recording preselected audio broadcasts in accordance with the program data manually set by a user based on the best projection of his/her routine or particular schedule. In addition to making latest traffic/weather information available in advance, an audio system in accordance with this invention is capable of automatically outputting the sound data of the recorded information either at a preselected time when a use is being waken up or when his/her vehicle is started. Said audio system is optionally afforded with an additional radio receiving means so that a user has a choice of continuously listening in to a musical broadcast during a preselected traffic/weather broadcast from a different radio station is being automatically recorded.

19 Claims, 7 Drawing Sheets

AUDIO SYSTEM PROGRAMMABLE FOR RECORDING PRESELECTED AUDIO BROADCASTS

FIELD OF THE INVENTION

The present invention relates to an audio system programmable for recording audio broadcasts, and more particularly to an improved audio system capable of automatically outputting the sound data of recorded audio broadcast while a user is being waken up or before he/she gets on the road.

BACKGROUND OF THE INVENTION

With increasing traffic congestion and weather changing, it is advantageous for a driver to stay apprised of latest traffic information as well as weather forecast. There exist several prior arts related to radio devices with recording capability. U.S. Pat. Nos. 5,463,599, 5,263,199, 5,126,982, 4,805,217, and 4,713,801 provide car radio devices with recording ability and other features, but none of them allows a user to achieve automatic recording of a preselected audio broadcast. U.S. Pat. No. 5,483,506 provides a car radio capable of directing a driver's attention to traffic broadcasting, but has no recording ability.

The car radio device described in U.S. Pat. No. 5,448,534 is able to detect and thus record a required broadcast, yet this function becomes operative only when the ignition switch of an engine is turned on or the engine of a vehicle is in a running mode. This is not surprised because in the common practice a car radio is designed to automatically stop its operation once the engine of a vehicle is stopped. Even any function of these conventional radio systems is activated, a driver cannot have any latest traffic or weather information unless a respective broadcasting time is reached. In this regard, radio stations in most cities broadcast traffic information and weather forecast only on a periodic basis. Mostly, it will not exceed six times in an hour, as reflected in the routine practice of the WWJ news radio station (950 KHz on AM band) in the metro-Detroit area: traffic and weather together every 10 minutes on the eighth. A driver commuting in a city or suburbs is mostly to get on the road without waiting for the coming periodic traffic broadcast, once his/her vehicle is started. Under these circumstances, the driver has no latest information for use in planing a proper driving route or in getting fully prepared for the forecasted weather changing.

The conventional prior arts have a further disadvantage in that when being directed to listen to a traffic or weather broadcast, a driver is forced to miss out on completing the enjoyment of a piece of music or a program being currently broadcast and listened. This type of interruption is highly undesirable for a driver preferring to complete his/her musical enjoyment before being directed to listen in to a traffic/weather broadcast.

OBJECTS OF THE INVENTION

Accordingly, a primary object of the present invention is to provide an audio system with various means by which preselected audio broadcasts are automatically recorded even when the engine of a vehicle is turned off, so as to allow a driver to have latest traffic/weather information in advance for correspondingly planning a proper driving route to avoid heading toward the area congested with traffic, and for obtaining an opportunity to become fully prepared for the forecast weather changing before gets on the road.

Another object of the present invention is to provide an audio system that allows a user to have a choice of staying tuned or manually tuning in to an audio broadcast such as music for instant listening while said audio system is concurrently recording a preselected broadcast such as traffic and/or weather information from a different station in accordance with program data.

Another object of the present invention is to provide an audio system with programmable means and basic instructions stored in read-only-memory means for simplifying the procedure of setting the program data for a series of constant-time-length events, so as to allow said series of constant-time-length events such as the traffic broadcasts that periodically occur around the clock to be automatically recorded for later reproduction or to be output for immediate listening.

SUMMARY OF THE INVENTION

According to the present invention, an audio system comprises power supply means, a radio receiving means, programmable means, a recording-and-reproducing unit, and microprocessor being consistently powered by said power supply means by which selected audio broadcasts can be automatically recorded in advance according to the program time data set by a driver based on the best projection of his/her coming or routine schedule.

According to another preferred embodiment of the present invention, an audio system is made to comprise at least two radio receiving, two channel selecting means, and other necessary means, by which said audio system affords a user a choice of staying tuned or manually tuning in to a broadcast such as music for instant listening in addition to the concurrent recording of a preselected broadcast such as traffic and/or weather information from a different radio station in accordance with program data.

According to still another preferred embodiment of the present invention, an audio system is made to comprise system control microprocessor and read-only-memory means therein stored necessary instruction data for simplifying the procedure of inputting program time data for a series of constant-time-length events and for automatically converting the simplified time data into necessary event starting-time data and event ending-time data so as to automatically record or output the sound data of preselected broadcasts such as traffic/weather, financial reports, sports, and news that periodically occur around the clock.

DETAILED DESCRIPTION OF THE PREFERRED EMBODIMENT

Figure 1:
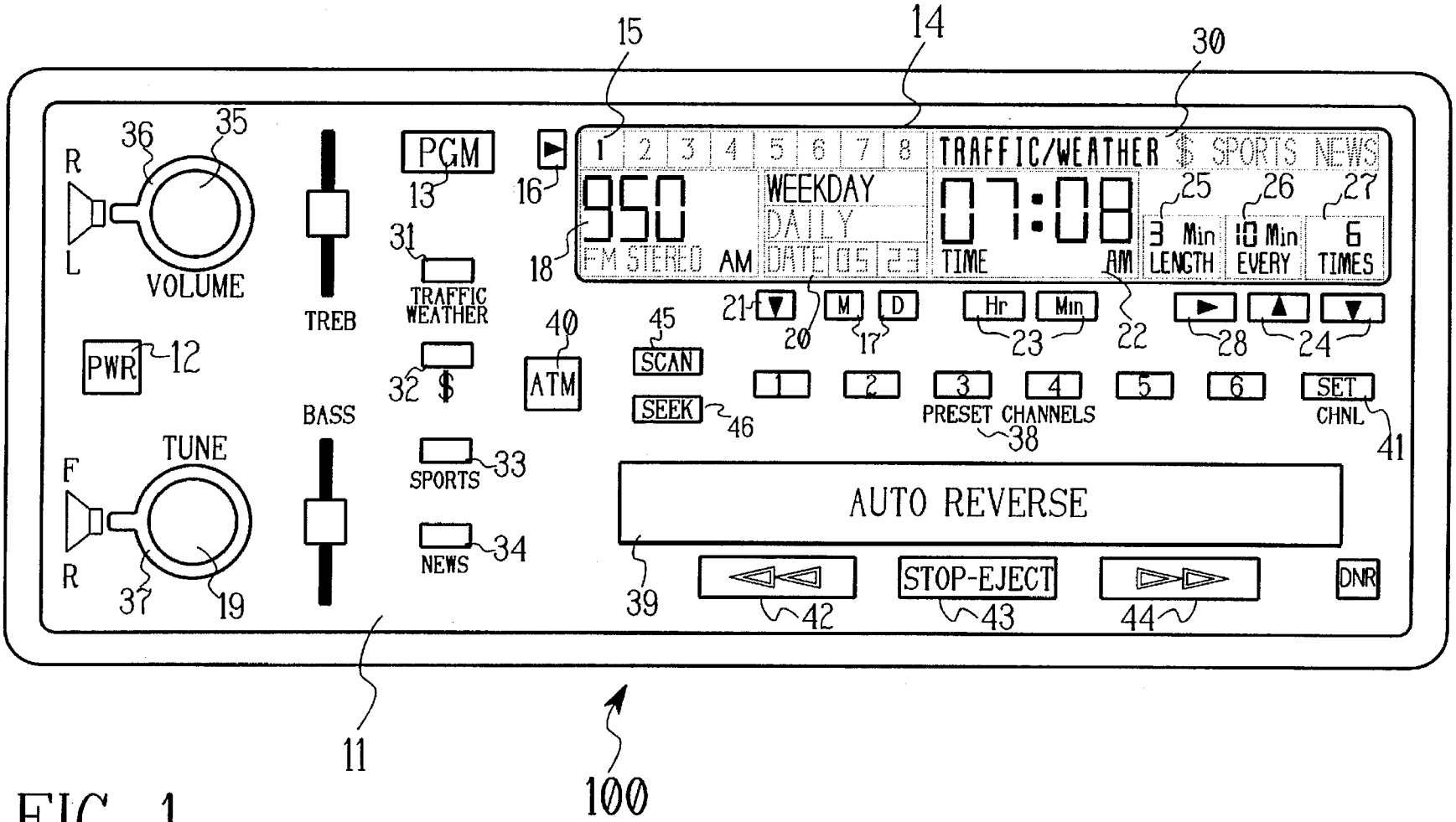
FIG. 1 is a front view of an audio system in accordance with a first preferred embodiment of the present invention, showing various manually-operatable input means and display means.

Referring now to FIG. 1, there is illustrated a front view of an audio system 100 in accordance with a first preferred embodiment of the present invention. Comprised in front panel 11 of audio system 100 are various manually-operatable input means and display means for setting programs to automatically record preselected broadcasts such as latest traffic information, weather forecast, financial reports, sports, and news in advance, so that a driver/user/listener can have latest information for reproduction before he/she gets on the road.

The sound output of audio system 100 is turned on and off by a power on/off button 12 (abbreviated as PWR on the drawing). Unlike the conventional car radios, audio system 100 is capable of recording information in accordance with its program data even if power on/off button 12 is turned off.

Figure 2:
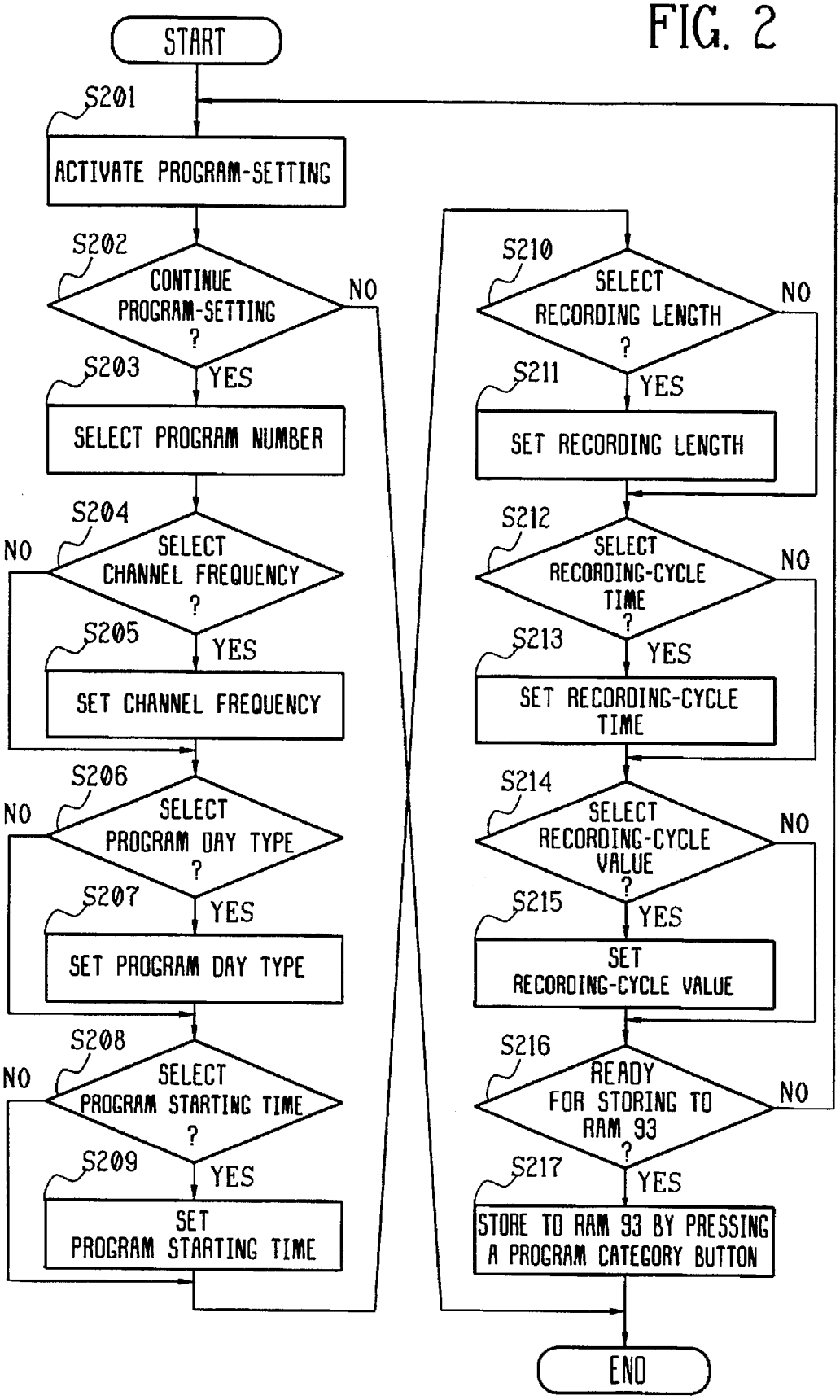
FIG. 2 is a flow chart showing a program-setting procedure through inputting simplified program time data to control the occurrence of a series of constant-time-length recordings or events for the audio system shown in FIG. 1 in accordance with a second preferred embodiment of the present invention.

Referring now also to the flow chart shown in FIG. 2, a program-setting procedure in accordance with a second preferred embodiment of the present invention involving the input of simplified program time data is described hereinafter. When a program-setting activation button 13 (abbreviated as PGM on the drawing) is pressed once, audio system 100 is activated into a program-setting mode or function (Step 201 or S201). Note that "Step" will be abbreviated as "S" hereinafter. Cancellation or abandon of the program-setting mode is achieved when program-setting activation button 13 is pressed at the second time (S202), or when there exists no setting input for 1 minute.

How to set program channel frequency will be given below. Currently shown on screen 14 of FIG. 1 is an illuminated display embodying the program-setting mode, having solid and dotted types of numbers and characters thereon that represent active and non-active settings, respectively. Dotted numbers and characters are shown for facilitating the illustration of the procedure of programming. Program number indicator 15 is shown to consist of all of the program numbers from 1 to 8, which can be replaced by a single-digit indicator. Program number selector 16 allows the scrolling of a program number to be selected from 1 to 8 (S203); currently, program number 1 is selected. The selection of a program number also recalls its respective data or settings, if any, previously stored therein. Channel frequency indicator 18 currently showing 950 AM, i.e., 950 KHz on amplitude modulation band (AM), is responsive to the tuning function of frequency selector 19, channel scan button 45, channel seek button 46, or preset channel buttons 38. The turning motion and the depressing motion of frequency selector 19 allow a frequency to be manually tuned and a radio reception to be manually switched between the AM (amplitude modulation) and the FM (frequency modulation) modes, respectively (S205). In a normal radio-reception operation of audio system 100, channel selection can also be achieved by manually pressing one of six preset channel buttons 38 each stores a preferred channel frequency as set previously through channel set button 41. Information stored in each of preset channel buttons 38 can be recalled for quickly inputting a channel-frequency setting to a recording program to be set.

Setting program time data will be described in accordance with the drawing shown in FIGS. 1 and 2. Program day-type indicator 20 is selectable among weekday, daily, and date by day-type selector 21 (S207), currently being set in weekday mode. When the active menu is scrolled to a date mode by program day-type selector 21, a particulate day can be set by means of month- and day-setting buttons 17. The date mode is especially advantageous in allowing a driver to set a recording program for collecting selected broadcasts on a particular day in accordance with his/her plan, so that audio system 100 will automatically make latest traffic/weather information available when the driver comes back from a trip to drive his/her vehicle, for instance, parked in a parking lot nearby an airport. When audio system 100 operates in a non-program-setting mode, day-type selector 21 is able to scroll an active menu to the date mode for setting the present date of today (currently showing May 23) by month- and day-setting buttons 17. Time indicator 22 currently set at 07:08 AM, changeable by hour- and minute-setting buttons 23 (S209), defines the program starting time point at which the first recording of the present program on each programmed day starts.

Increase- and decrease-setting buttons 24 are respectively used to integrally increase and decrease each setting value of an active menu, which is activated by mode-setting selector 28, selectable among recording length indicator 25, recording-cycle time indicator 26, and recording-cycle value indicator 27. Currently, recording length indicator 25 shows that the length of recording is set for 3 minutes long (S211). Recording-cycle time indicator 26 currently showing a value of 10 defines that recording is currently set to reoccur every 10 minutes from the starting time point of program number 1 (S213). Recording-cycle value indicator 27 currently displaying a value of 6 signifies that recording of the preselected channel will be repeatedly executed 6 times in total (S215). Setting the recording-cycle value has two-fold purposes: (1) preventing a vehicle battery from being drained, and (2) allowing a driver to best achieve the collecting of latest traffic/weather information by means of compensating the possible inaccuracy of projecting his/her schedule and/or the occurrence of other unexpected events. The recording-cycle value is reset to the original value, when a system control microprocessor (to be discussed in detail in FIG. 3) detects the turn-on or -off signal of an ignition switch (to be shown in FIG. 3) of an engine, which indicates the vehicle battery has a chance of being recharged.

In brief, these three setting values and other time data and channel-frequency data mentioned above define that recording of a radio broadcast at a channel frequency of 950 KHz starts at 07:08 AM for a recording length of three minutes, stops for a length of seven minutes, repeats the three-minute recording on the next eighths (including 18th, 28th, 38th, 48th, and 58th minutes) of the clock for a total of six times, and reoccurs everyday except for Saturday and Sunday as long as there exists a reoccurrence request to activate the proceeding of the program on a next programmed day. Note that program number 1 is completed at 08:11:00 AM on each of the programmed days.

This method of setting program time data greatly simplifies the procedure of setting programs for controlling the proceeding or occurrence of a series of constant-time-length events. Said events can be of various recordings or sound outputtings of preselected broadcasts. Otherwise, the set of program number 1 above-mentioned has to be separately stored in six different programs in accordance with the conventional practice; a user has to mathematically figure out various recording starting-time and recording ending-time data for all recording events or cycles. This is not only tedious but requires greater program numbers or addresses for storage.

In accordance with the present invention, if all setting codes or parameters are correct (S216), by pressing traffic/weather button 31 (S217), these codes are stored to RAM 93 (will be shown and discussed in FIG. 4); meanwhile, screen 14 switches from the program-setting mode to a non-program-setting mode in that time indicator 22 will display a present time rather than a program time, and the dotted numbers/characters and the rest of other indicators become invisible except for channel frequency indicator 18 and program category status indicator 30. In the non-program-setting mode, an illuminated display of "traffic/weather" on program category status indicator 30 signifies the existence of a program or programs aiming for the automatic recording of preselected traffic/weather broadcasts. The illuminated traffic/weather display shown by program category status indicator 30 is made to glow much brighter to indicate that a preselected traffic/weather broadcast is currently being recorded.

Broadcasts of different categories such as financial reports, sports, and news can be similarly programmed for recording in a categorized manner through pushing other program-category input means including $ button 32, sports button 33, and news button 34. Once programmed, audio system 100 is capable of automatically performing the recording of the preselected radio broadcasts even when the power on/off button 12 is turned off. Preferably, a designated area of the information storage medium is assigned for storing the contents of a series of constant-time-length recordings for each program so that the latest broadcast can be instructed to over-write the oldest broadcast in the same category. Thus, a driver or listener is always provided with the latest information.

Collected latest broadcasts are reproduced by turning on power on/off button 12, if needed, and then pressing either traffic/weather button 31, $ button 32, sports button 33, or news button 34 in accordance with the desire of a driver or listener. This allows a plurality of recorded broadcasts to be reproduced in a categorized manner. The level of sound output is controlled by the turning motion of volume controller 35, and can be directed in a biased manner to four loudspeakers (not shown) by turning speaker controllers 36 and 37 clockwise or counter-clockwise. Upon completion of reproduction, audio system 100 returns to its normal operation such as receiving a radio reception at a frequency previously tuned, or playing a cassette tape proceeded in cassette player 39. Audio system 100 further comprises an automatic monitoring button 40 (abbreviated as ATM in the drawing) for automatically causing audio system 100 to pause any manually-activated sound output not actuated in accordance with the program data, so as to output the audio signals of a preselected broadcast when an instant time is coincident with the program starting time or recording-starting time data of a program.

Figure 3:
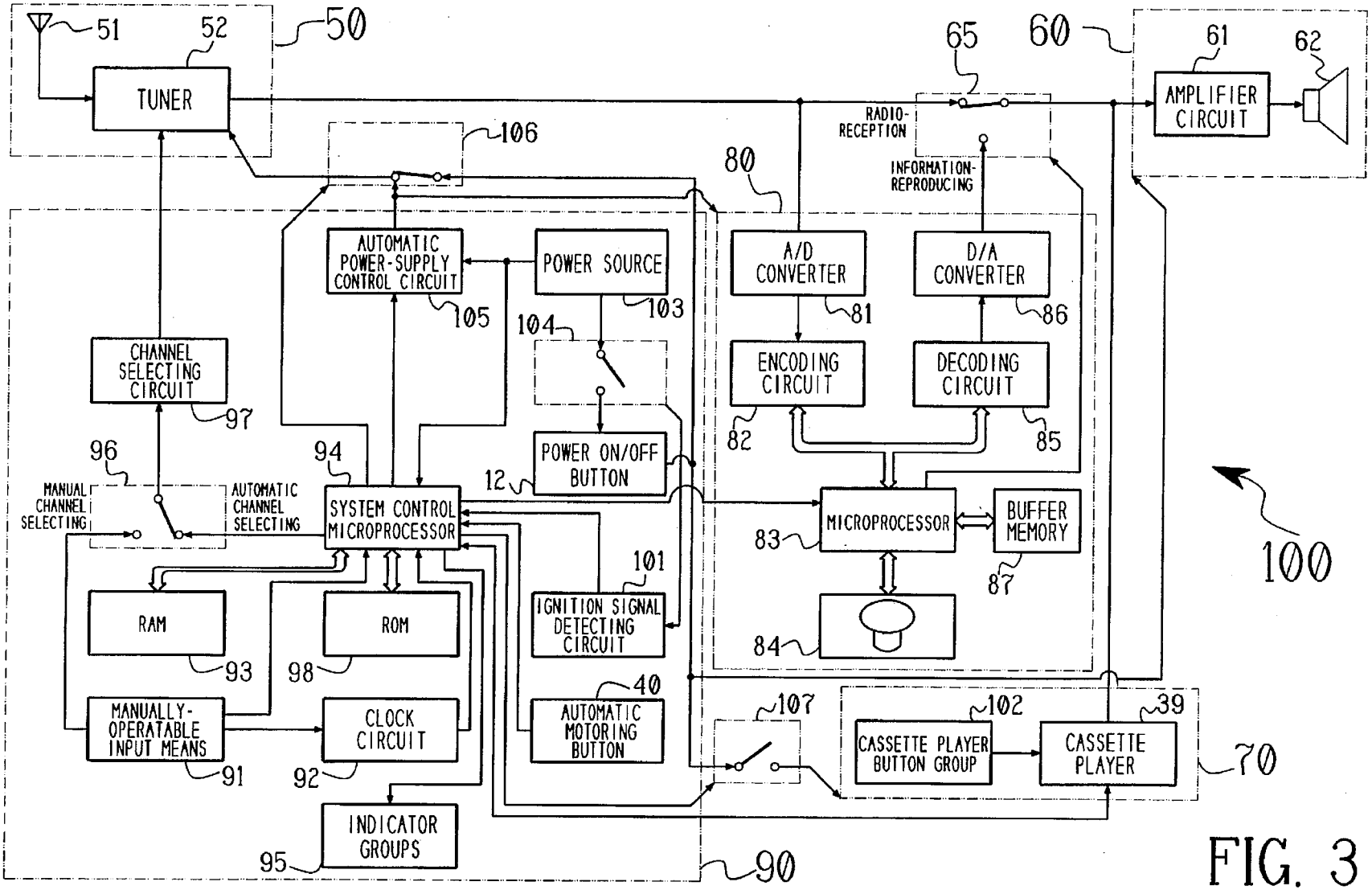
FIG. 3 is a block diagram of the audio system shown in FIG. 1 in accordance with the first preferred embodiment of the present invention.

FIG. 3 is a block diagram of the audio system 100 shown in FIG. 1 in accordance with the first preferred embodiment of the present invention. Audio system 100 basically includes a radio receiving unit 50 for receiving radio waves in a predetermined range of frequency, a sound output unit 60 for producing audible sounds, a cassette player unit 70 for playing a pre-recorded cassette tape, a recording-and-reproducing unit 80 operative in information recording and reproducing, a power supply system, and a system control unit 90 for controlling the operation modes of audio system 100 selectable among program data setting, radio reception, information recording, information reproducing, and cassette tape playing.

Radio receiving unit 50 comprises a reception antenna 51 and a tuner 52 for receiving broadcast signals from amplitude modulation (AM) or frequency modulation (FM) transmissions. Tuner 52 may be of any constructions, such as a conventional radio, an ARI-type radio for receiving a DK signal transmitted by Traffic Information Identification broadcast, or a RDS-type radio for receiving a TA signal transmitted by Radio Data System broadcasts.

Sound output unit 60 comprises an amplifier circuit 61 for amplifying audio signals and a loudspeaker 62 for converting the audio signals to an audible level. The input of audio signals is controlled by a selecting switch 65. Normally, selecting switch 65 is in a radio-reception mode, allowing sound output unit 60 to receive audio signals from radio receiving unit 50. However, selecting switch 65 changes into a information-reproducing mode so as to allow the audio signals reproduced from recording-and-reproducing unit 80 to output to sound output unit 60, when received a control signal from microprocessor 83. Sound output unit 60 will receive the audio signals from cassette player unit 70, when cassette player 70 operates in a playing mode. The playing mode sends a signal to system control microprocessor 94 for turning off the producing of other audio signals, if any, from either radio receiving unit 50 through power-supply controller 106 or from recording-and-reproducing unit 80 operating in the information-reproducing mode through microprocessor 83 and automatic power-supply control circuit 105.

Recording-and-reproducing unit 80 comprises an A/D converter circuit 81 for converting an audio signal into a digital signal suitable for recording, an encoding circuit 82 for encoding and compressing the digital signal, a microprocessor 83, a buffer memory 87, a data storage device 84 for storing compressed digital information, a decoding circuit 85 for reversing the coding process performed in encoding circuit 82, and a D/A converter circuit 86 for converting a digital signal into an analog audio signal. The information-recording operation is performed by A/D converter circuit 81, encoding circuit 82, microprocessor 83, buffer memory 87, and data storage device 84. Buffer memory 87, which is a random access memory (RAM), serves as a buffer memory storage for temporarily storing the data to be processed; while, data storage device 84 is a magnetic-type recording device such as a hard-disk drive or a writable optical drive, holding information independent of power existence. A magnetic-tape means is less preferred for use in storing data, because all intervening data have to be sequentially searched until the desired data have been found. During recording, microprocessor 83 receives coded and compressed digital data from encoding circuit 82 and stores the data to data storage device 84. As controlled by microprocessor 83, the storage area of data storage device 84 is divided into four categories each for storing a category of information selected from traffic/weather, financial reports, sports, and news as actuated by program-category input means including traffic/weather button 31, $ button 32, sports button 33, and news button 34, respectively. Microprocessor 83 further instructs the storing of information to take place in a manner that in each category of recording, the latest broadcast information to be recorded over-writes the oldest recorded broadcast information. Therefore, the content of the recording stored on the memory medium of data storage device 84 always remains latest so as to meet a user's anticipation in having the latest information at need.

The information-reproducing operation is proceeded by microprocessor 83, data storage device 84, buffer memory 87, decoding circuit 85, and D/A converter circuit 86. Upon system control unit 90 senses a reproduction request actuated by pushing either traffic/weather button 31, $ button 32, sports button 33, or news button 34, the information-reproducing mode is activated and microprocessor 83 sends a signal to change selecting switch 65 from a normal radio-reception mode to a information-reproducing mode so as to output the audio signals reproduced from recording-and-reproducing unit 80 to sound output unit 60. Because information stored in data storage device 84 is categorized, the reproduction of the information is proceeded in a systematic manner so as to allow a listener to quickly retrieve all of the latest information associated in the same category by pushing a button selected from traffic/weather button 31, $ button 32, sports button 33, and news button 34.

Microprocessor 83 has multitasking capability so that the presence of buffer memory 87 allows both the information-recording operation and the information-reproducing operation to be simultaneously proceeded. This allows audio system 100 to reproduce the recorded information for listening and at the same time to record another preselected broadcast in accordance with the program data previously set. The simultaneous proceeding of recording and reproducing is further improved when a hard-disk drive has two independently-movable read/write heads.

System control unit 90 having various control means controls audio system 100 to function in an automatic manner so as to proceed an automatic mode or program-running mode for recording information, and in a manual manner so as to proceed the program-setting mode for setting program data, the channel-setting mode for setting and storing a preselected channel frequency to one of preset channel buttons 38 (shown in FIG. 1), the time-setting mode for setting a present time, the radio-reception mode for receiving a radio broadcast, the information-reproducing mode for reproducing information, and a cassette-playing mode for playing a cassette tape. The settings of these manual modes are input manually by keying in various inputs from manually-operatable input means 91 comprising preset channel buttons 38, channel set button 41, channel scan button 45, channel seek button 46, frequency selector 19, program-setting activation button 13, program number selector 16, day-type selector 21, month- and day-setting buttons 17, hour- and minute-setting buttons 23, mode-setting selector 28, increase- and decrease-setting buttons 24, traffic/weather button 31, $ button 32, sports button 33, and news button 34, as shown in FIG. 1 and discussed in detail hereinbefore.

Manually-operatable input means 91 are manually operatable for generating signals respectively sent to clock circuit 92 for setting a present time, to tuner 52 for selecting a channel frequency to be tuned, or through system control microprocessor 94 to RAM 93 (random access memory) for forming program channel-frequency data and program time data of a program to be set. These data through system control microprocessor 94 are displayed on indicator groups 95 comprising program number indicator 15, channel indicator 18, program day-type indicator 20, time indicator 22, recording length indicator 25, recording-cycle time indicator 26, recording-cycle value indicator 27, and program category status indicator 30, as shown in FIG. 1. The indicator may be of a light emission diode (LED), giving a visual-type display for facilitating the proceeding of programming or parameter setting. The visual-type display may be replaced by or incorporated with a speech generator (not shown) for producing voice-type generator in response to an input keyed in from manually-operatable input means 91 during the proceeding of programming.

System control unit 90 further comprises a channel-mode selecting switch 96 that allows audio system 100 to operate either in a manual channel selecting mode or in an automatic channel selecting mode. The automatic channel selecting mode is in effect, only when system control microprocessor 94 detects a coincidence signal between a current time and program starting-time or recording starting-time data. The manual channel selecting mode of channel-mode selecting switch 96 allows the delivering of a signal actuated by a button selected from manually-operatable input means 91 directly to channel selecting circuit 97 for altering channel frequency. In either mode, channel selecting circuit 97 generates and delivers a channel selecting signal corresponding to the manually-selected channel frequency or to the program channel-frequency data by means of a tuning voltage, for instance, to tuner 52 and controls it.

Once programmed, audio system 100 is capable of operating in the program-running mode for automatically collecting preselected broadcasts in accordance with the program channel-frequency data and program time data of each program stored in RAM 93. In order to arrive at the program-running mode, system control unit 90 is made to comprise system control microprocessor 94, and ROM (read only memory) 98 containing basic instructions needed for instructing the operation of system control microprocessor 94. Permanently stored in ROM 98 are a first set of basic instructions for requesting the input of program channel frequency and program time data, and a second set of basic instructions for converting program time data stored in RAM 93 into recording starting-time data and recording ending-time data for each of recording cycles of a program and for changing or resetting the recording-cycle value, and a third set of basic instructions for determining preset program coincidence so as to actuate the on and off of each recording.

Figure 4:
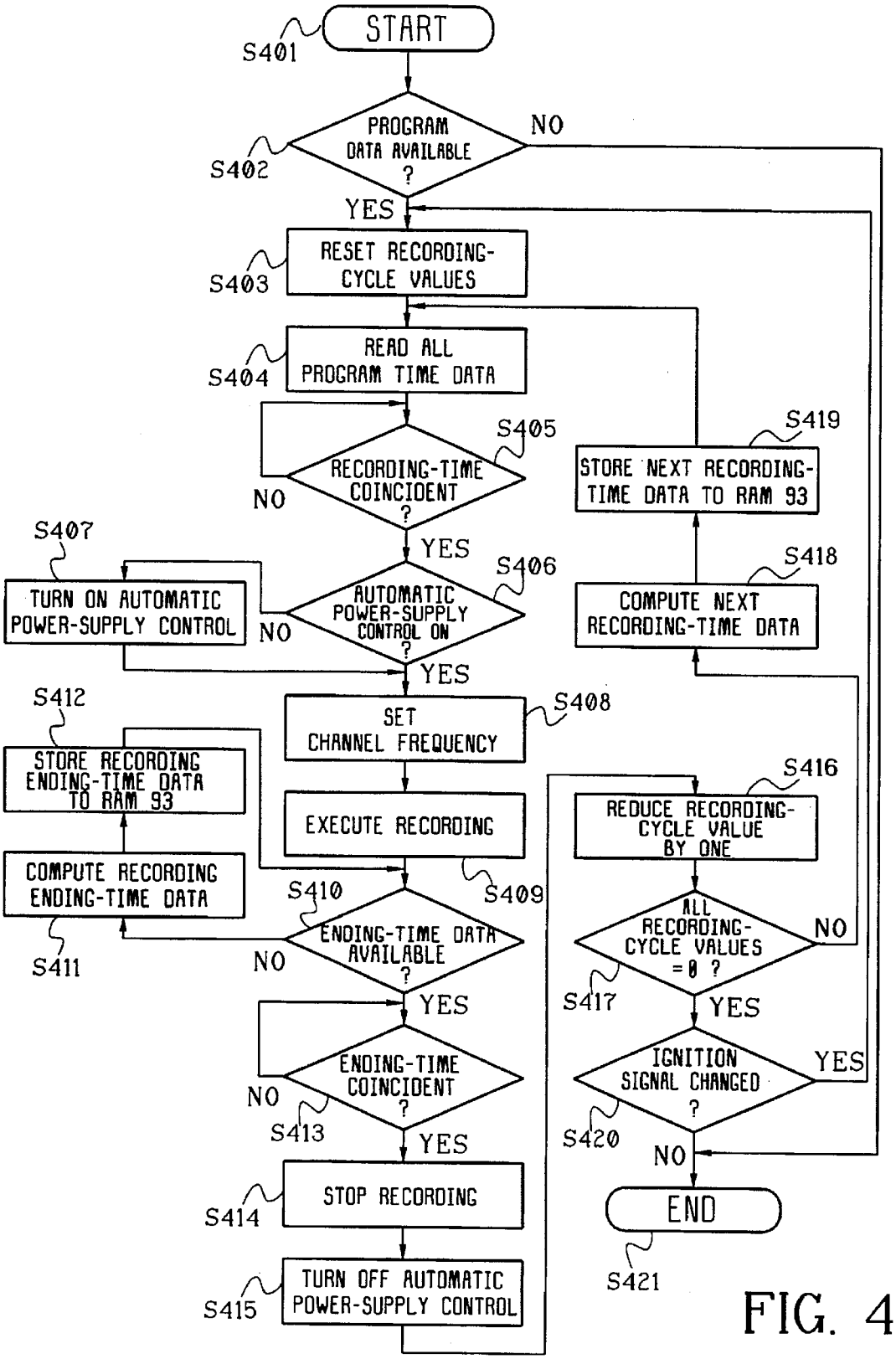
FIG. 4 is a flow chart showing that the audio system of FIG. 3 utilizes the simplified program time data shown in FIG. 2 to proceed automatic recording in accordance with the second preferred embodiment of the present invention.

Referring now also to the flow chart shown FIG. 4, the procedure of audio system 100 of FIG. 3 operating in the program-running mode for automatically collecting preselected broadcasts is described hereinafter. FIGS. 2 and 4 together reflect a second embodiment of the present invention for greatly simplifying the procedure of setting a program to control a series of constant-time-length recordings or events. While FIG. 2 shows that audio system 100 is made programmable for accepting simplified program time data, FIG. 4 specifically demonstrates that audio system 100 is capable of utilizing the simplified program time data to control the proceeding of a series of constant-time-length recordings or events.

The program-running mode or automatic mode of audio system 100 is activated (S401) when system control microprocessor 94 detects a status-signal change of ignition switch 104 from ignition signal detecting circuit 101, or senses the activation of program setting by the pushing of program-setting activation button 13 (FIG. 1 ). The former indicates that a vehicle is being or has been driven and thus the vehicle battery is recharged with sufficient power for audio system 100 to perform another series of recording for a next programmed day; while, the later signifies that audio system 100 has been either programmed or reprogrammed. If sensing the existence of program time data stored in RAM 93 (S402), system control microprocessor 94 resets recording-cycle values to their original values in accordance with the second set of basic instructions stored in ROM 98 (S403). System control microprocessor 94 reads all program time data (S404) so as to find and choose the program with the program starting time being nearest to a current time code read out from clock circuit 92 for execution. In accordance with the third set of basic instructions for determining preset program coincidence, system control microprocessor 94 compares by every one minute the program time data, either program starting-time or recording-time data (month, day, hour, and minute), read out from the program data stored in RAM 93 with the instant time data (month, day, hour, minute) of clock circuit 92 (S405). When these are coincident with each other, system control microprocessor 94 outputs a coincidence signal to effect an automatic power-supply control circuit 105 in supplying power, if necessary, to radio receiving unit 50 and to recording-and-reproducing unit 80 (S407). Then, system control microprocessor 94 sends a channel selecting signal in accordance with the program channel-frequency data stored in RAM 93 to channel selecting circuit 97 for actuating tuner 52 to receive a preselected frequency accordingly (S408), and also sends a signal to microprocessor 83 for effecting its role in controlling the recording of recording-and-reproducing unit 80 (S409). Audio signals received by tuner 52 is then sent to recording-and-reproducing unit 80 for recording. Thus, recording of a preselected broadcast is started at the starting time of a program.

Once recording starts, system control microprocessor 94 checks if there exist respective recording ending-time data (S410). If not, system control microprocessor 94 converts (S411) the recording length data stored in RAM 93 into recording ending-time data and stores (S412) the data to RAM 93 in accordance with the second set of basic instructions stored in ROM 98. When a current time of clock circuit 92 coincides with the recording ending-time data, system control microprocessor 94 sends an ending signal to microprocessor 83 to end the present recording of the program and causes automatic power-supply control circuit 105 to turn off the power supplied to recording-and-reproducing unit 80 (S413, S414, and S415). This forms one recording event out of a series of constant-time-length recording events for a program and reduces the recording-cycle value of the program that stores in RAM 93 by one (S416) in accordance with the second set of basic instructions stored in ROM 98. Next recording cycle will continue once system control microprocessor 94 first computes next recording-time data (S418), stores the computed data to RAM 93 (S419), and then routes the program execution step back to S404 until all recording-cycle values become zero (S417) that signifies the entire recording processes of all programs are completed for the programmed day.

When senses an ignition-status-signal change from ignition signal detecting circuit 101 due to the turn-on or -off of ignition switch 104 of an engine of a vehicle, system control microprocessor 94 directs the execution from S420 to S403 so as to reset the recordingcycle value to the original value of the program time data stored in RAM 93; therefore, the entire recording process of a program will start all over (for instance, beginning at 07:08 AM in accordance with program number 1 shown in FIG. 1) for the next programmed day. However, if there exists no turn-on or -off signal, indicating the vehicle has not being driven in accordance with the driver's schedule, the entire recording process is accordingly ended (S421); thus, no recording will be executed on the next programmed day.

Cassette player unit 70 shown in FIG. 3 comprises cassette player 39 and cassette button group 102 including rewind button 42, stop-eject button 43, and fast forward button 44 as shown in FIG. 1. Power supplied from power switch 107 to cassette player unit 70 is controllable by system control microprocessor 94 so that power is supplied as long as rewind button 42 or fast forward button 44 remains in a push-down or active position; while, power for actuating the operation of playing is interruptedly turned off by system control microprocessor 94, when system control microprocessor 94 senses a reproduction request activated by the manual pushing of either traffic/weather button 31, $ button 32, sports button 33, or news button 34. The playing operation is also made interruptedly stoppable through power switch 107 controlled by system control microprocessor 94 when recording-and-reproducing unit 80 is proceeding the recording operation and automatic monitoring button 40 is in a turn-on position at the same time.

The turn-on of automatic monitoring button 40 (FIGS. 1 and 3) generates and holds a signal to system control microprocessor 94 for requesting system control microprocessor 94 to monitor whether there exists any manually-activated sound output not actuated in accordance with the program data, such as sound output from cassette player unit 70, from radio receiving unit 50 operating at a manually-tuned frequency, and from recording-and-reproducing unit 80 operating in information-reproducing mode. If detecting any manually-activated sound output, system control microprocessor 94 stores a code representing the proceeding of the manually-activated sound output to RAM 93. System control microprocessor 94 then generates necessary control signals to automatically stop or pause the proceeding of the manually-activated sound output, so as to output the audio signals of a preselected broadcast to sound data output unit 60 when system control microprocessor 94 detects a coincidence signal between a current time and program or recording starting-time data, so as to activate the information recording function of recording-and-reproducing unit 80. When detecting a coincidence signal between a current time and recording ending-time data, system control microprocessor 94 generates and sends necessary control signals in accordance with the respective code previously stored in RAM 93 so as to allow the proceeding of the manually-activated sound output to resume. Also contained in ROM 98 is another set of basic instructions allowing the abandon of the sound output of a programmed broadcast when system control microprocessor 94 receives a signal for proceeding manual-activated sound production.

A power supply system included in audio system 100 as shown in FIG. 3 is described hereinafter. The power supply system comprises a power source 103, manually-controllable power distributing means including power on/off button 12, and microprocessor-controllable power distributing means including automatic power-supply control circuit 105, power supply switch 106, and power switch 107. System control unit 90 is always energized by power source 103 in order for the program-running mode or automatic recording to take place in accordance with the program data stored in RAM 93, even when ignition switch 104 of a vehicle engine is manually turned off. Ignition switch 104, currently open as shown in FIG. 3, controls the supply of power to power on/off button 12 that provides a manual control over the turning-on or -off of the power to sound output unit 60, cassette player unit 70, and tuner 52. Thus, manually actuated operation of audio system 100 will automatically stop once the vehicle engine is turned off. The power manually supplied to tuner 52 from power on/off button 12 is further controlled by a power supply switch 106 controllable by system control microprocessor 94. In the program-running mode, tuner 52 is afforded with power from automatic power-supply control circuit 105 that is controlled by system control microprocessor 94 so as to provide audio signals at a preselected frequency for recording-and-reproducing unit 80 to proceed information recording in accordance with the program data. Power switch 107 is used for the automatic control of recording-and-reproducing unit 80, as described hereinbefore. With the power supply system, audio system 100 is thus able to perform various recording operations without draining a vehicle battery.

In addition to manual reproduction, the recorded information is automatically reproduced when system control microprocessor 94 receives a request signal generated by automatic monitoring button 40 prior to a turn-on signal of ignition switch 104 detected by ignition signal detecting circuit 101. In other words, as long as automatic monitoring button 40 remains activated for generating and holding a request signal, recording-and-reproducing unit 80 is instructed by system control microprocessor 94 to automatically reproduce the recorded information once the engine of a vehicle is started.

Figure 5:
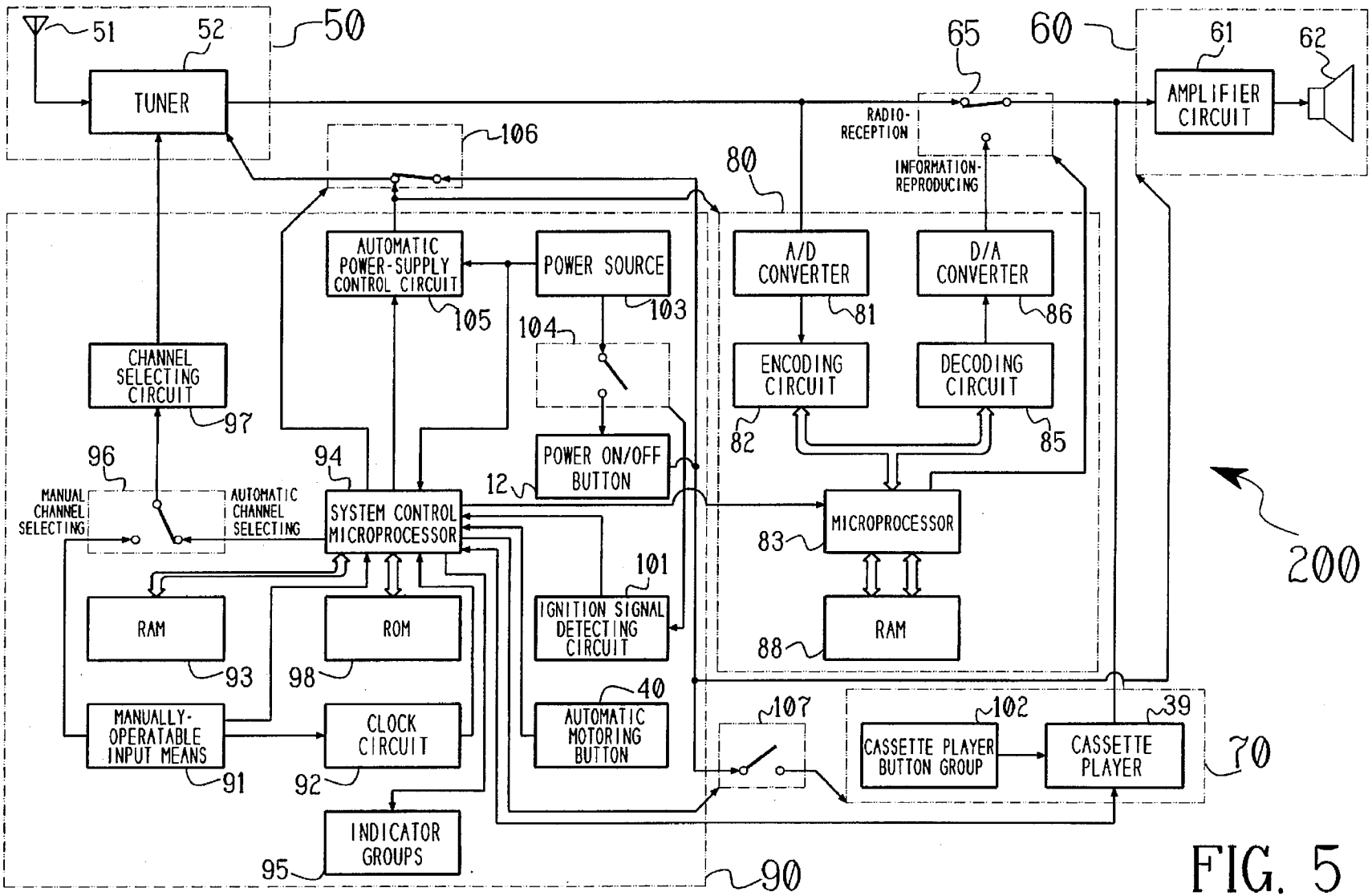
FIG. 5 is a block diagram showing an audio system in accordance with a third preferred embodiment of the present invention.

FIG. 5 shows a third preferred embodiment of the present invention, in which audio system 200 is nearly identical to audio system 100 of FIG. 3 except that hard-disk drive 84 and buffer memory 87 of FIG. 3 are replaced by RAM 88 as a means for storing data. In this embodiment, power is consistently supplied to RAM 88 for maintaining the data stored therein for 2 hours, for instance, upon the completion of the entire recording process of a program for the programmed day. After the 2-hour waiting interval, the data becomes less useful (especially for traffic information); thus, system control microprocessor 94 instructs automatic power-supply control circuit 105 to turn off the power supplied to RAM 88 for conserving power.

Figure 6:
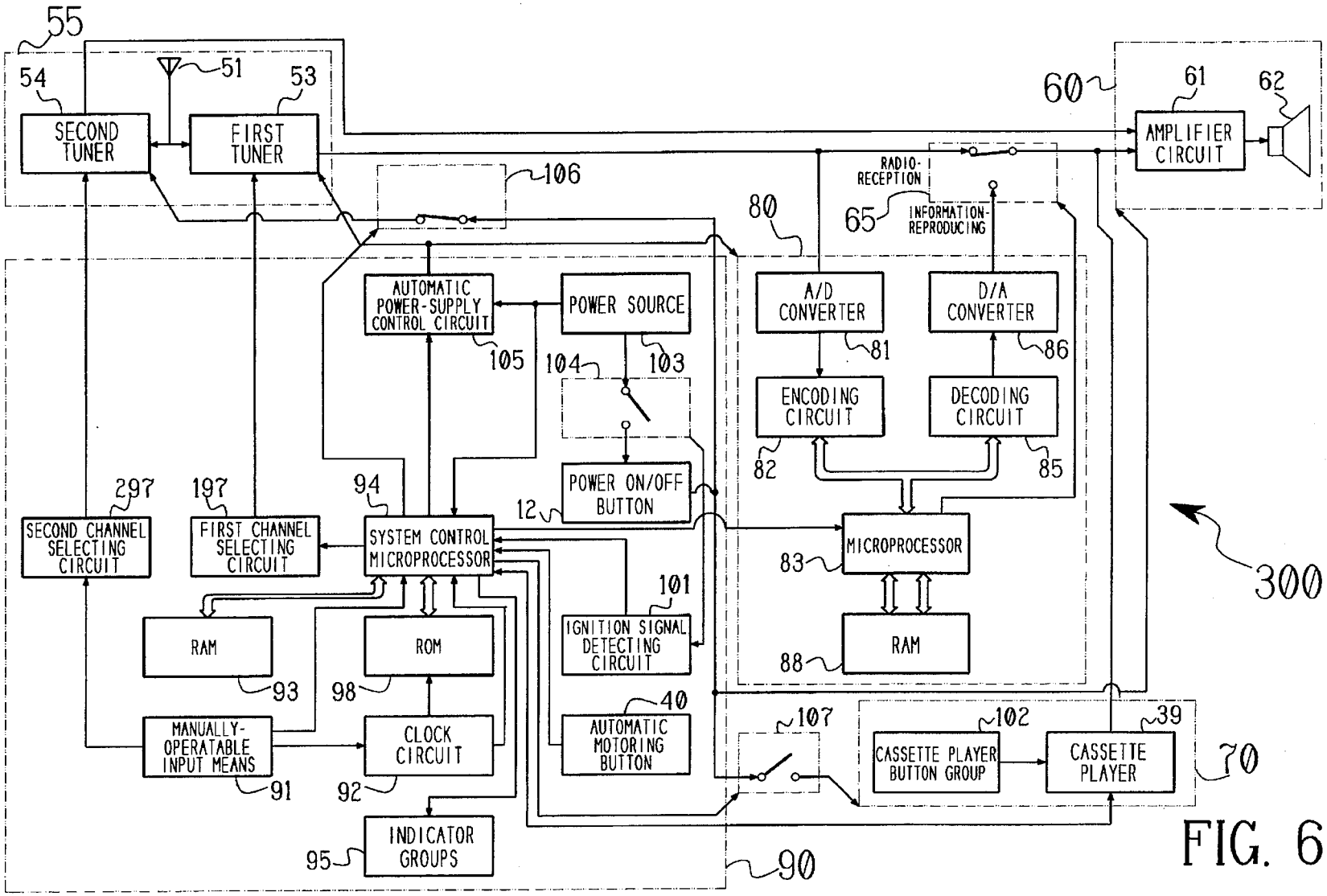
FIG. 6 is a block diagram showing an audio system in accordance with a fourth preferred embodiment of the present invention.

FIG. 6 illustrates a fourth preferred embodiment of the present invention, in which audio system 300 is nearly identical to audio system 200 of FIG. 5, except that audio system 300 allows a driver to listen in to a broadcast different from that being recorded at the same time. In audio system 300 of FIG. 6, radio receiving unit 55 comprises a second tuner 54 and system control unit 90 has a second channel selecting circuit 297 that delivers a tuning voltage to second tuner 54 and controls it in accordance with a manual input activated from manually-operatable input means 91, specifically by frequency selector 19 or preset channel buttons 38 shown in FIG. 1. The audio signal of second tuner 54 is directly output to sound output unit 60. On the other hand, first channel-selecting circuit 197 is controlled by system control microprocessor 94 for delivering a tuning voltage to first tune 53 in order to receive the audio signals from a radio station at a preselected channel frequency in accordance with the program data. The audio signals of first tuner 53 shown in FIG. 6 goes through selecting switch 65, which operates in a manner identical to that embodied in FIG. 3 and detailed thereof previously. When recording-and-reproducing unit 80 is in the processing of recording a traffic/weather broadcast, system control microprocessor 94 sends a signal to cause respective program category status indicator to glow brighter, indicating that traffic/weather information is currently being broadcast and recorded. At this moment, a driver has a choice to switch his/her immediate attention to the traffic/weather broadcast being currently recorded by recording-and-reproducing unit 80 or to stay tuned to an initial broadcast being currently listened or to tune in to a different broadcast for immediate listening. Accordingly, while first tuner 53 is automatically tuned to receive a preselected broadcast in accordance with the program data stored in RAM 93 for outputting audio signals to recording-and-reproducing unit 80 for recording, second tuner 54 is manually controllable for outputting the audio signals of a different broadcast to sound output unit 60 in accordance with the immediate listening desire of a driver. In essence, audio system 300 allows a driver to listen in to a piece of music or a program being currently broadcast without any unpleasant interruption in the flow of enjoyment and at the same time it makes latest traffic/weather information available for reproduction at need.

Figure 7:
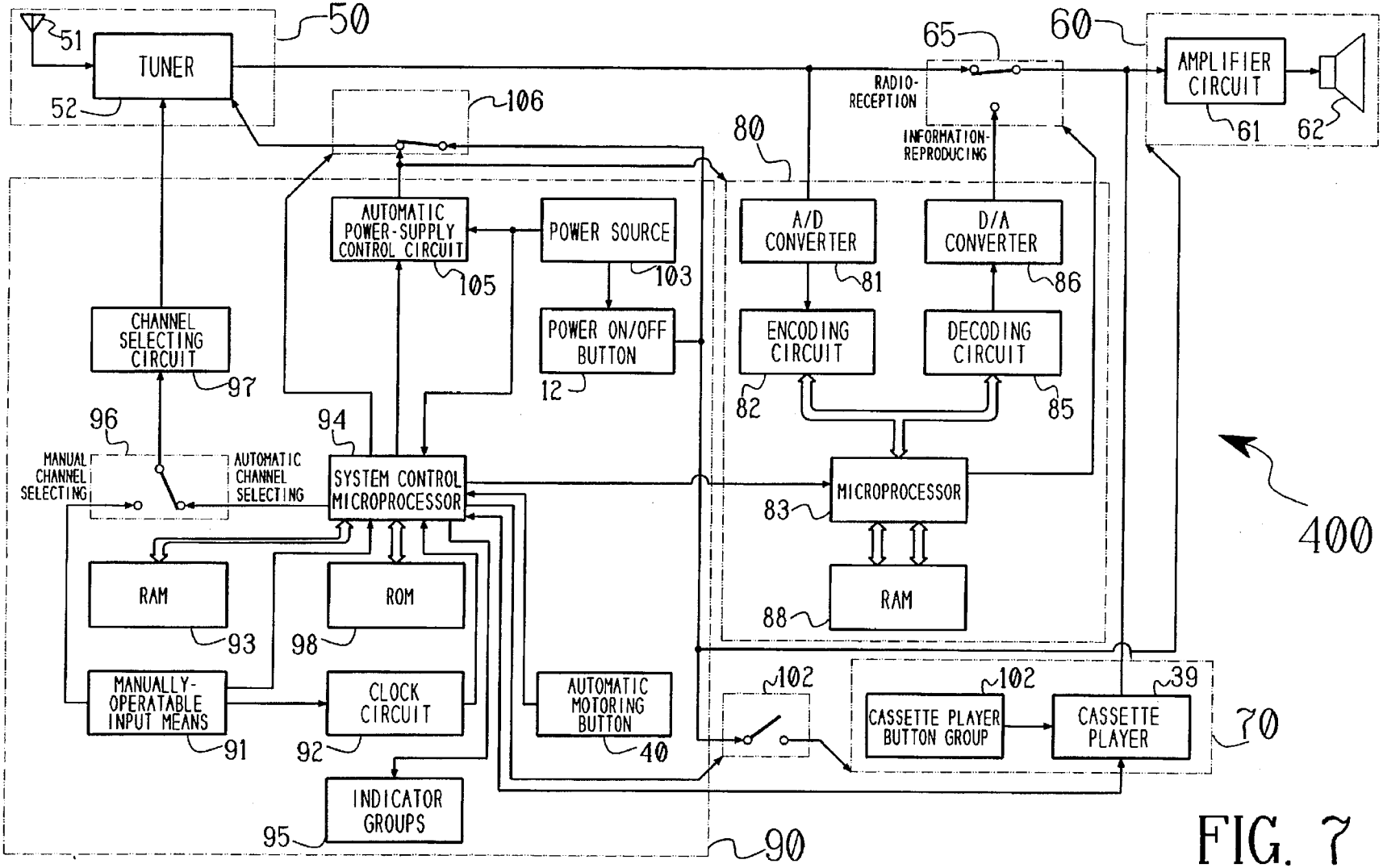
FIG. 7 is a block diagram showing an audio system in accordance with a fifth preferred embodiment of the present invention.

FIG. 7 illustrates a fifth preferred embodiment of the present invention, in which audio system 400 is nearly identical to audio system 200 of FIG. 5, except that audio system 400 generally used as a radio or specifically here as an alarm radio has no ignition signal detecting circuit 101 and its power supply is not controlled by ignition switch 104 as those shown in FIG. 3. However, in audio system 400, manually-operatable input means 91 further comprises a wake-up button and ROM 98 stores a fourth set of basic instructions, allowing a user to set a wake-up time at which recorded broadcasts are automatically reproduced so as to provide the sound output of the latest traffic or weather information for waking up a user from sleep. The wake-up time is set at a time slightly later than the program ending time at which the entire recording process of a program is completed for a programmed day. When detecting a coincidence signal between a current time and the wake-up time, system control microprocessor 94 sends a signal to actuate automatic power-supply control circuit 105 for supplying power to recording-and-reproducing unit 80 so as to automatically reproduce the recorded information. System control microprocessor 94 further allows audio system 400 to resume its program-running mode for the next programmed day, upon the completion of information reproducing or upon the detecting of a stop request manually actuated either due to the changing of channel frequency or the pushing of a stop button additionally included in manually-operatable input means 91.

Although these preferred embodiments have been described hereinbefore as applied to a car radio and an alarm radio, the present invention is applicable to other audio receiving systems for the same effects as those described herein. Thus, it is clearly understood that such embodiments are provided by way of illustration and example only and is not to be taken by way of limitation as numerous variations, changes, modification, and substitutions will occur to those skilled in the art without departing from the invention herein. Accordingly, it is intended that the invention be limited only by the spirit and scope of the appended claims.

What is claimed is:

1. An audio system programmable for recording preselected audio broadcasts, the audio system comprising:

(a) radio receiving means for receiving audio signals;

(b) recording-and-reproducing means comprising a data storage means, for recording audio signals to said data storage means and for reproducing recorded audio signals from said data storage means;

(c) sound data output means for outputting audio signals generated by said radio receiving means and by said recording-and-reproducing means;

(d) a plurality of manually-operable input means comprising channel-frequency-setting input means and time-setting input means for setting program data of a program, including program channel-frequency data and program time data;

(e) memory storing means for storing said program data input by said plurality of manually-operable input means;

(f) clock means for affording current time data;

(g) channel selecting means responsive to a signal so as to control said radio receiving means for receiving audio signals at a channel frequency in accordance with said program channel-frequency data;

(h) system control microprocessor means for detecting when a current time from said clock means coincides with said program time data stored in said memory storing means, and for causing said channel selecting means to generate and hold a channel selecting signal in accordance with said program channel-frequency data, so as to actuate said recording-and-reproducing means to perform information recording in accordance with said program data; and (i) a power supply system comprising a power source, a first set of power distributing means and a second set of power distributing means, said power source selectively supplying power to said system control microprocessor means through one of said first and second sets of power distributing means, said first set of power distributing means being manually controllable for distributing power from said power source at least to said radio receiving means and to said recording-and-reproducing means, and said second set of power distributing means being automatically controllable by said system control microprocessor means for distributing power from said power source at least to said radio receiving means and to said recording-and-reproducing means in accordance with said program time data.

2. The audio system of claim 1 further comprising an ignition signal detecting means capable of detecting a turn-on or -off signal of an ignition switch of an engine, for requesting said system control microprocessor means to reactivate the execution of said program for a next programmed day.

3. The audio system of claim 2 further comprising automatic monitoring means for generating and holding a signal for requesting said recording-and-reproducing means to perform information reproduction when said system control microprocessor means receives a turn-on signal from said ignition signal detecting means.

4. The audio system of claim 1, wherein said channel selecting means is further responsive to a signal generated in accordance with manual activation of said channel-frequency-setting input means for generating and holding a channel selecting signal so as to control said radio receiving means for receiving audio signals at a channel frequency manually selected.

5. The audio system of claim 1, wherein said plurality of manually-operatable input means further includes program-category input means for requesting a plurality of recorded broadcasts to be reproduced in a categorized manner.

6. The audio system of claim 1 further comprising automatic monitoring means for generating and holding a signal for requesting said system control microprocessor means to automatically pause the proceeding of any manually-activated sound output not actuated in accordance with said program data, so as to output the audio signals of a preselected broadcast to said sound data output means in accordance with said program data.

7. The audio system of claim 6, wherein said automatic monitoring means causes said system control microprocessor means to store a code representing said proceeding of manually-activated sound output to said memory storing means so as to allow said proceeding of manually-activated sound output to resume when said system control microprocessor detects a coincidence signal between a current time from said clock means and recording ending-time data of said program data stored in said memory storing means.

8. The audio system of claim 1 further comprising a cassette player having a cassette playing function pausable and resumable by said system control microprocessor means in accordance with said program time data.

9. The audio system of claim 1 further comprising a means selected from the group consisting of visual-type display means, voice-type generating means, and the combination of both, wherein said means is responsive to an input actuated by said manually-operatable input means for facilitating the proceeding of setting programs.

10. An audio system capable of being manually controlled to output sound data of a broadcast for immediate listening while automatically recording a preselected broadcast, said audio system comprising:

(a) at least two radio receiving means, each capable of independently receiving audio signals;

(b) recording-and-reproducing means comprising a data storage means, for recording audio signals to said data storage means and for reproducing recorded audio signals from said data storage means;

(c) sound data output means for outputting audio signals generated by either one of said at least two radio receiving means and by said recording-and-reproducing means;

(d) a plurality of manually-operable input means comprising channel-frequency-setting input means and time-setting input means for setting program data of a program, including program channel-frequency data and program time data;

(e) memory storing means for storing said program data input by said plurality of manually-operable input means;

(f) clock means for affording current time data;

(g) at least two channel selecting means, one being responsive to a signal generated in accordance with automatic activation of said program channel-frequency data for generating and holding a channel selecting signal so as to control one of said at least two radio receiving means for receiving audio signals at a preselected channel frequency in accordance with said program data, and another of said at least two channel selecting means being responsive to a signal generated in accordance with manual activation of said program channel-frequency input means for generating and holding a channel selecting signal so as to control another of said at least two radio receiving means for receiving audio signals at a channel frequency manually selected;

(h) system control microprocessor means for detecting when a current time from said clock means coincides with said program time data stored in said memory storing means, and for causing said one of said at least two channel selecting means to generate and hold a channel selecting signal in accordance with said program channel-frequency data, so as to actuate said recording-and-reproducing means for performing information recording in accordance with said program data; and (i) a power supply system comprising a power source means, a first set of power distributing means and a second set of power distributing means, said power source means selectively supplying power to said system control microprocessor means through one of said first and second sets of power distributing means, said first set of power distributing means being manually controllable for distributing power from said power source at least to said another of said two radio receiving means and to said recording-and-reproducing means, and said second set of power distributing means being controllable by said system control microprocessor means for distributing power from said power source at least to said one of said at least two radio receiving means and to said recording-and-reproducing means in accordance with said program data.

11. The audio system of claim 10 further comprising ignition signal detecting means capable of detecting a turn-on or -off signal of an ignition switch of an engine, for requesting said system control microprocessor means to reactivate the execution of said program for a next programmed day.

12. The audio system of claim 11 further comprising automatic monitoring means for generating and holding a signal for requesting said recording-and-reproducing means to perform information reproduction when said system control microprocessor means receives a turn-on signal from said ignition signal detecting means.

13. The audio system of claim 10, wherein said plurality of manually-operatable input means further includes program-category input means for requesting a plurality of recorded broadcasts to be reproduced in a categorized manner.

14. The audio system of claim 10 further comprising automatic monitoring means for generating and holding a signal to request said system control microprocessor means to automatically pause the proceeding of any manually-activated sound output not actuated in accordance with said program data, so as to output the audio signals of a preselected broadcast to said sound data output means in accordance with said program data.

15. The audio system of claim 14, wherein said automatic monitoring means causes said system control microprocessor means to store a code representing said proceeding of manually-activated sound output to said memory storing means so as to allow said proceeding of manually-activated sound output to resume when said system control microprocessor detects a coincidence signal between a current time from said clock means and recording ending-time data of said program data stored in said memory storing means.

16. An audio system programmable for controlling at least a series of constant-time-length radio broadcast events said audio system comprising:

(a) at least one radio receiving means for receiving audio signals;

(b) recording-and-reproducing means for recording audio signals and for reproducing recorded audio signals;

(c) a plurality of manually-operable input means for setting program data of a program, including program channel-frequency data and program time data;

(d) writable memory storing means for storing said program data input by said plurality of manually-operable input means;

(e) read only memory means;

(f) a first set of basic instructions stored in said read only memory means, for requesting an input of said program time data to include program starting-time data defining the starting time point of the first event of a series of constant-time-length events of a program, event length data defining said constant time length for each event of said program to last each time, event cycle time defining the time length between two successive events, event-cycle value defining the total number of constant-time-length events to take place for one programmed day;

(g) a second set of basic instructions stored in said read only memory means, for effecting a computation of event ending-time data and next event starting-time data in accordance with said program time data stored in said writable memory storing means;

(h) dock means for affording current time data;

(i) microprocessor means for processing the request of inputting said program time data to said writable memory storing means in accordance with said first set of basic instructions, for computing said event ending-time data and said next event starting-time data from said program time data stored in said writable memory storing means in accordance with said second set of basic instructions stored in said read only memory means, for effecting the proceeding of storing said computed time data to said writable memory storing means, and for determining when a current time from said clock means coincides with said computed time data stored in said writable memory storing means, so as to actuate said control system to control a periodic occurrence of said constant-time-length events in accordance with said program data; and (j) a power supply system comprising a power source means and a set of power distributing means, said power source means selectively supplying power to said microprocessor means through said set of power distributing means, said set of power distributing means being controllable by said microprocessor means for distributing power in accordance with said program data.

17. The audio system of claim 16, wherein said constant-time-length events are selected from the group consisting of information recordings for later reproduction, sound outputtings of preselected broadcasts for immediate listening in accordance with said program data, and the combination of said information recordings and said sound outputtings.

18. The audio system of claim 16 further comprising means for setting a time at which said recording-and-reproducing means is actuated by said microprocessor means to reproduce recorded broadcasts.

19. The audio system of claim 16 further comprising means selected from the group consisting of visual-type display means, voice-type generating means, and the combination of both responsive to an input actuated by said manually-operatable input means for facilitating the proceeding of setting programs.

* * * * *